United States Patent [19]

Ruckdeschel et al.

[11] Patent Number: 5,056,284

[45] Date of Patent: Oct. 15, 1991

[54] BUNDLED TENSIONING MEMBER FOR PRESTRESSING A TALL STRUCTURAL MEMBER AND METHOD OF INSTALLING SAME

[75] Inventors: Franz Ruckdeschel; Reinhard Klöckner; Dieter Jungwirth, all of Munich; Gero Herrmann, Karlsfeld, all of Fed. Rep. of Germany

[73] Assignee: Dyckerhoff & Widmann AG, Munich, Fed. Rep. of Germany

[21] Appl. No.: 378,136

[22] Filed: Jul. 11, 1989

[30] Foreign Application Priority Data

Jul. 19, 1988 [DE] Fed. Rep. of Germany ..... 3824394

[51] Int. Cl.[5] ..... E04C 5/08

[52] U.S. Cl. ..... 52/230; 52/223 R; 52/744

[58] Field of Search ..... 52/230, 223 R, 223 L, 52/225, 698, 744

[56] References Cited

U.S. PATENT DOCUMENTS

| | | | |
|---|---|---|---|
| 3,866,273 | 2/1975 | Brandestini et al. | 52/223 L X |
| 4,223,497 | 9/1980 | Edwards | 52/230 |
| 4,235,055 | 11/1980 | Schambeck | 52/230 |
| 4,594,827 | 6/1986 | Finsterwalder | 52/230 |
| 4,693,044 | 9/1987 | Jartoux | 52/230 |
| 4,718,965 | 1/1988 | Finsterwalder et al. | 52/230 X |

*Primary Examiner*—David A. Scherbel
*Assistant Examiner*—Creighton Smith
*Attorney, Agent, or Firm*—Toren, McGeady & Associates

[57] ABSTRACT

To facilitate the construction of a very high structural member for use in a body of water such as at an offshore location with the structural member extending from the floor of the body of water to above its surface, tensioning members are inserted into relatively narrow tensioning ducts accessible only from the top of the structural member. The tensioning members, such as steel rods, steel wires, or steel wire strands, are provided with members for effecting a positive locking engagement in a hardenable material forming an anchored length of the tension member at the lower end of the tensioning ducts. Initially, the tension members are lowered into the lower ends of the ducts and then are grouted in the ducts by a hardenable material. After the hardenable material has set over an anchored length, the tension members are tensioned within the ducts. Next, the tensioned length of the tension members in the ducts is grouted with a hardenable material to provide a composite action with the structural member. Accordingly, the tension members are securely positioned within the tensioning ducts and are effectively anchored.

11 Claims, 3 Drawing Sheets

FIG. 1
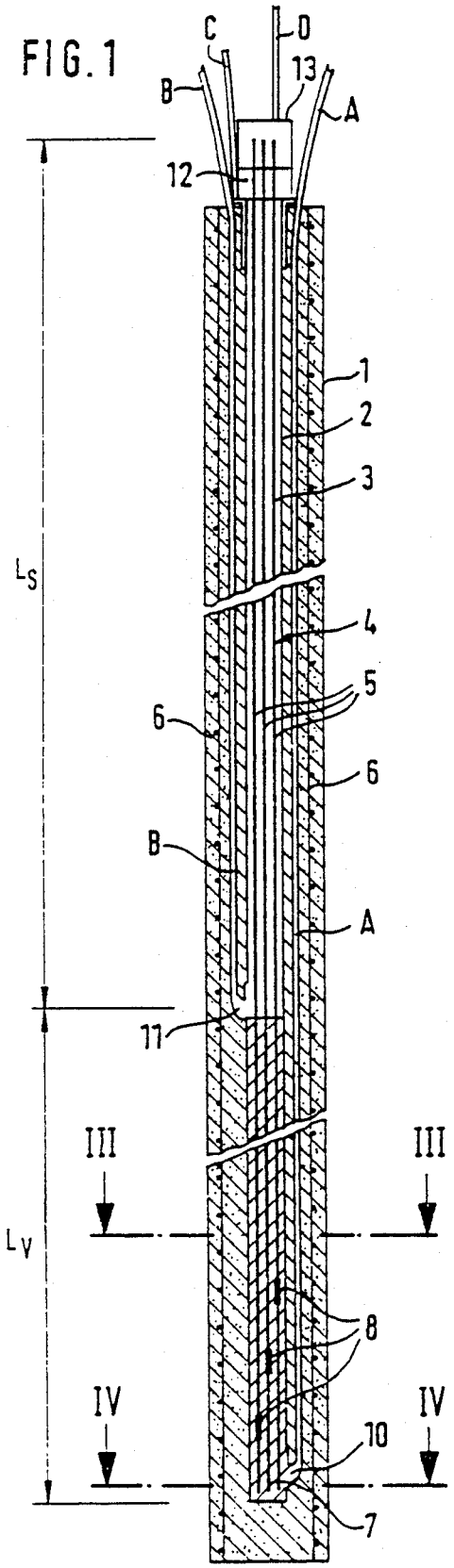
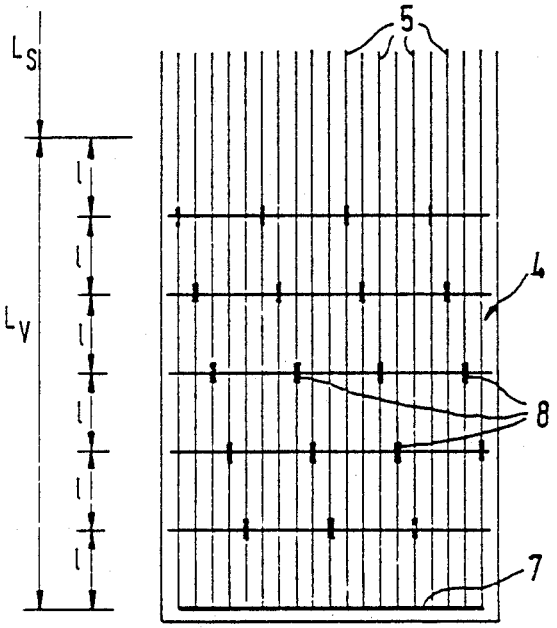
FIG. 2
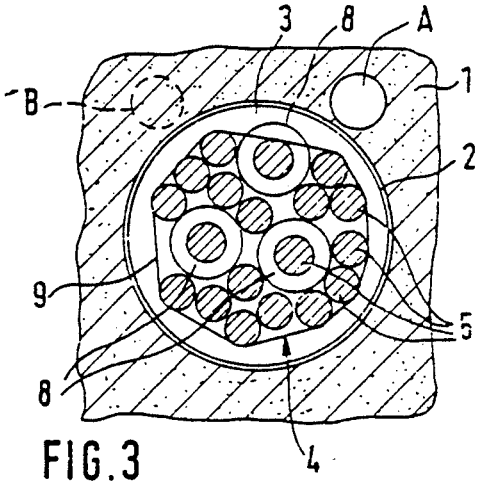
FIG. 3
FIG. 4
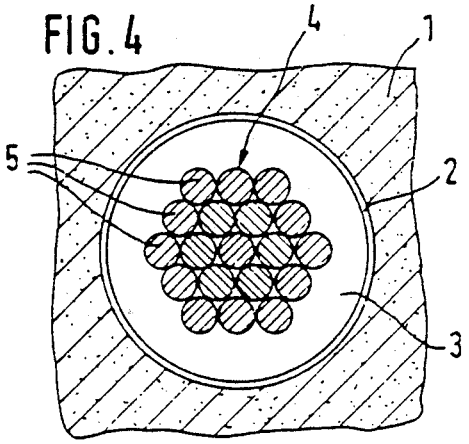

A
B
C
D
3
4
10
11
12
13
14
15
Ls
Lv

BUNDLED TENSIONING MEMBER FOR PRESTRESSING A TALL STRUCTURAL MEMBER AND METHOD OF INSTALLING SAME

BACKGROUND OF THE INVENTION

The present invention is directed to a very long bundled tensioning member for prestressing concrete with subsequent composite action within a tall structural member. The tensioning member is formed of a plurality of individual elements such as steel rods, steel wires or steel wire strands, and is insertable into a tensioning duct provided in the structural member with the duct in the form of a sheathing pipe or tube extending generally upwardly, vertically or diagonally, and accessible only at its upper end. The bundled tensioning member is anchored at one end within the tensioning duct and, subsequently, it is anchored by means of an anchoring disk. The invention is also directed to the method of installing the tensioning member.

Particularly in off-shore areas, it is often necessary to construct comparatively tall structural members of prestressed concrete, such as foundation elements for platforms or the like, extending from the ocean floor to above the surface of the water. Usually, such foundation elements are first constructed in a dock so as to float at a corresponding water depth by using a sliding construction, where the structural member sinks into the water in proportion to its height. In the course of such sliding construction, untensioned reinforcement and sheathing pipes for tensioning ducts can be installed, however, the tensioning members can only be introduced, tensioned and anchored for the full height of the structural member after it is completed.

Since the dimensions of such man-made structures has been optimized, that is, kept as small as possible for reasons of economy, a problem results in the installation of tensioning members, usually bundled tensioning members, for accommodating high loads in very narrow tensioning ducts, accessible only from one end. Usually, the other end of the duct is 50 m or more below the surface of the water. An effective anchorage must be provided within the narrow tensioning duct, since subsequent corrections are not possible. This anchorage must not take up more space than the tensioning member itself, because the sheathing pipe for the tensioning duct must have the same diameter along its full length to afford the introduction of the tensioning member.

The installation of steel tie rods or tensioning members in hollow spaces accessible from one end with the anchorage of the tension member at the inaccessible end is known in general in the installation of ground and rock anchors. To form the anchorage for securing the tension members, a hardenable material is injected into the base of the borehole, and the tension member is then tensioned from the opposite end and anchored by means of known anchoring devices used in prestressed concrete construction. The free length of the tension member between the anchorage and the anchoring device is freely extensive. Similar construction methods are known in anchoring structures, such as retaining walls, dam walls or the like, in the ground.

The known procedures for installing ground and rock anchors cannot be easily transferred to the production of prestressed concrete structures. Usually, there is enough space available in the ground for forming sufficiently large boreholes, even if costs increase with the diameter. Moreover, if such anchors prove to have insufficient bearing ability during subsequent monitoring, it is almost always possible to produce a new anchor. In underwater construction, which must satisfy the requirements of prestressed concrete structures, such replacement is not possible.

Accordingly, in the construction procedure mentioned above, it has been necessary to provide tensioning ducts for use in the erection of structural members with hairpin-shaped reversing points at their lower ends so that a tensioning member inserted in a tensioning duct can be tensioned at both ends from the upper end of the duct. To enable the insertion of the tensioning members into the tensioning ducts, large radius curvatures must be provided at the reversing points. Since the tensioning members must be arranged close to one another, they intersect in the region of the reversing points whereby causing a correspondingly great thickness of the structural member. Moreover, tensioning members in the form of steel wire strands have a long but limited length whereby only structural member height corresponding at most to half the length of the tensioning members can be achieved using such hairpin-shaped tensioning members. For larger structural member heights, intermediate joints in the tension members are needed and must also be hairpin-shaped.

SUMMARY OF THE INVENTION

Therefore, the primary object of the present invention is to provide a tensioning member to be installed in a tensioning duct where only one end of the duct is accessible and to anchor the tensioning member at the end of the duct spaced from the accessible end so that the duct can be completely filled for obtaining subsequent composite action and where the tensioning member can be monitored.

In accordance with the present invention, the tensioning member is constructed of individual elements securely connected to one another, for instance, by welding, at the end of the tensioning member spaced from the accessible end of the tensioning duct. In addition, the individual elements are provided with means for effecting additional anchorage with the hardenable material injected into the tensioning duct for affording a positive locking action with the hardenable material so that subsequent composite action is achieved for anchoring the tensioning member along a determined length.

Means for effecting additional anchorage of the individual elements are preferably arranged offset relative to one another. In a bundled tensioning member where the individual elements are formed of steel wire strands, the means for additional anchorage is provided by metallic sleeves pressed onto the wire strands, such as in a cold extrusion.

It is known in reinforced concrete and prestressed concrete construction to improve the composite action of reinforcing members by means of additional features, such as by providing ribs, anchoring members or the like or by arranging bulges in steel wire strands in an upsetting action, note DE 25 57 072B2.

It is also known to press a metallic sleeve onto a wire cable, a steel rod, or the like, along with deformation, provided by extrusion molding. Note, DE 12 71 961B2.

In accordance with the present invention, the means for additional anchorage of the individual elements in a bundled tensioning member are disposed in offset relation, relative to one another along the anchored length of the member, but not along the tensioned length adjacent the open end of the tensioning duct. Such an arrangement has the advantage that the individual elements can be welded to one another at the anchored end. Such interconnection of the elements is necessary to wind the entire tensioning member which is often very long, on a winder and to lower it into the tensioning duct in a reliable manner. Another advantage is that the means for additional anchorage, which usually increases the diameter of the individual elements, for instance, where metal sleeves are pressed onto the elements, simultaneously forms spacers for maintaining the individual elements spaced from one another in the region of the anchored length for assuring complete embodiment in the hardenable material injected into the tensioning duct. This assemblage of the tensioning member minimizes its diameter in the region of the anchored length. Accordingly, comparatively narrow sheathing pipes can be used for the tensioning duct affording small construction dimensions.

Furthermore, the present invention is directed to a method of installing the bundled tension member in a structural member where the hardenable material is first injected or grouted into the tensioning duct along the region of the anchored length after the tensioning member has been inserted into the tensioning duct. The injection of the hardenable material can be effected through a first grouting line having an outlet opening at the lower end of the anchored length. After the grouted material is hardened, the tensioning member is tensioned and anchored by an anchoring device. Next, hardenable material is injected into the tensioning duct along the region of the tensioned length using a second grouting line with an outlet opening positioned at the upper end of the anchored length. Preferably, the first and second grouted lines are located outside the tensioning duct.

After grouting the anchored length, it is possible that the hardenable material may penetrate into the region of the tensioned length and, if so, it can be removed by flushing the tensioning duct through the second grouting line. This flushing procedure can be continued and periodically repeated until the anchoring hardenable material begins to set.

To prevent corrosive sea water from entering the tensioning ducts while working at an off-shore location, it is advisable to fill the ducts with fresh water and to seal them with a cap after installing the tensioning member through the accessible end, whereby the water is displaced when the hardenable material is injected into the duct.

The upper region of the duct can be subsequently grouted with hardenable material through a third grouting line located outside the duct and opening into it at a location below the anchoring device.

In this connection, it is substantial, but not vital, to the invention when constructing the structural member, that for the sheathing pipes, forming the tensioning ducts, two pipes are installed at the same time connected together outside the ducts with the connection extending from the lower end of one duct and opening into the upper end of the adjacent duct. By locating the lines outside of the tensioning ducts, the diameter of the ducts can be kept small. Reliable grouting of the anchored length and the tensioned length with a hardenable material can be achieved using the grouting lines and in addition monitoring whether the tensioning duct is actually completely filled with hardenable material in the region of the anchored length as well as in the region of the tensioned length. Assuring the complete filling of the tensioning duct is of decisive importance for the production of prestressed concrete with subsequent composite action.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DESCRIPTION OF THE DRAWINGS

In the drawings:

FIG. 1 is a vertical section of a structural member, such as a wall, interrupted twice along its length and illustrating a tensioning member placed within a tensioning duct;

FIG. 2 is a schematic developed view of the individual elements forming the tensioning member in the region of their anchored length;

FIG. 3 is a cross-sectional view taken along the line III—III in FIG. 1.

FIG. 4 is a cross-sectional view taken along the line IV—IV in FIG. 1.

DETAILED DESCRIPTION OF THE INVENTION

Figures 5A, 5B, 5C, 5D, 5E:
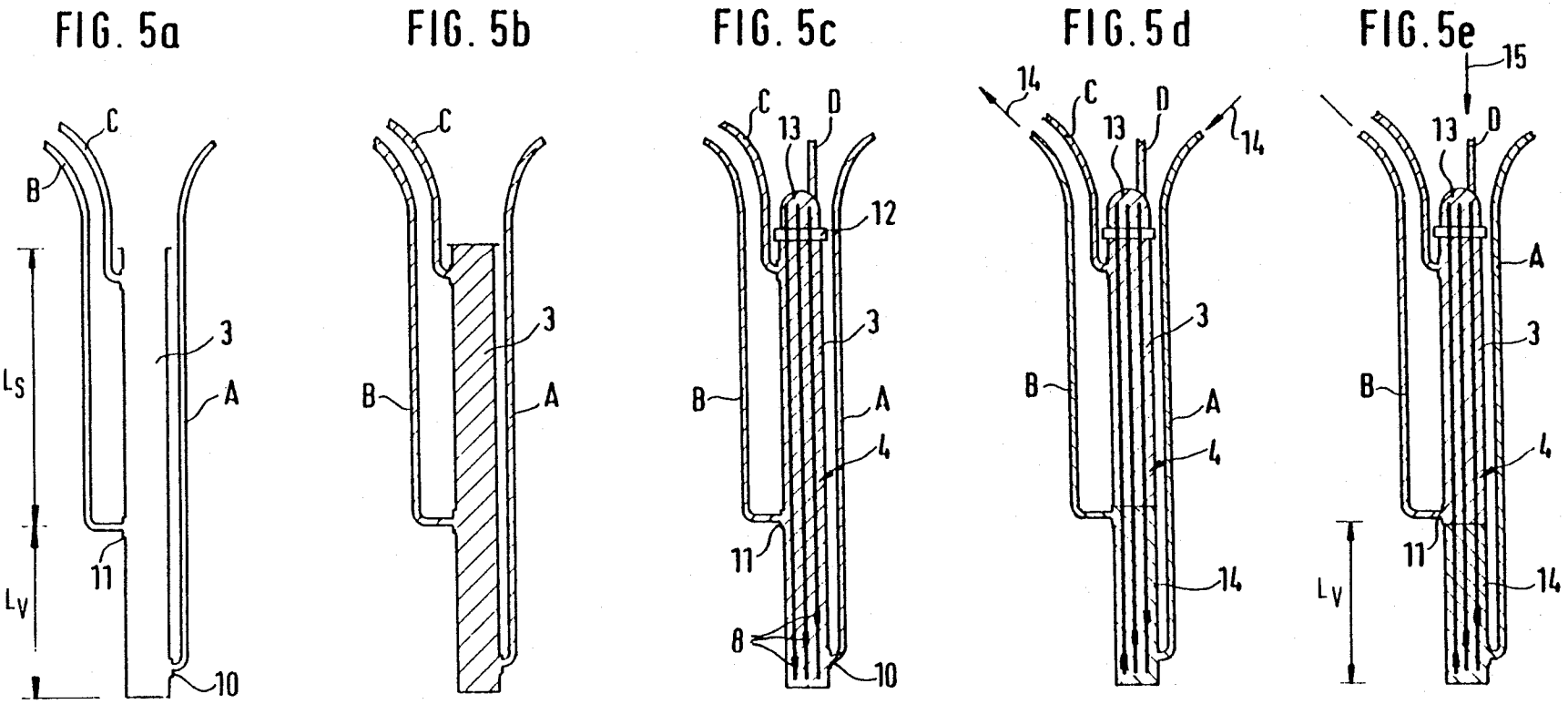
FIGS. 5*a* to 5*6*, display schematic views showing in series the various steps involved in carrying out the method embodying the present invention.
Figure 5I:
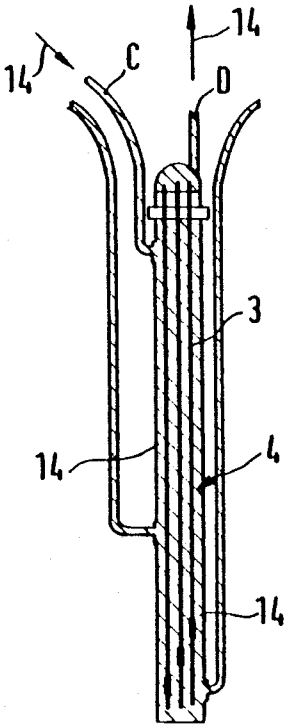
Figure 5H:
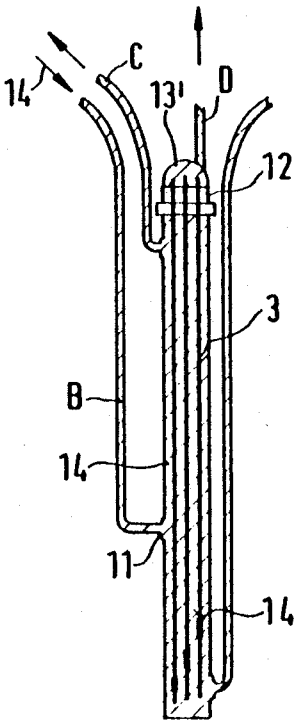
Figure 5G:
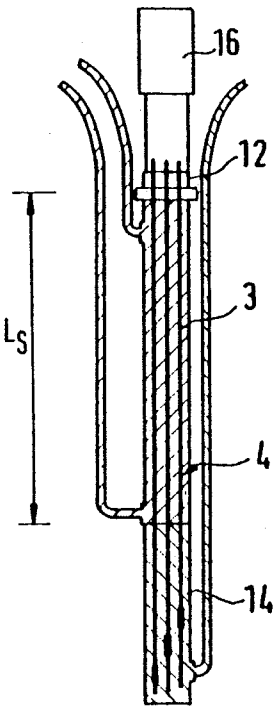
Figure 5F:
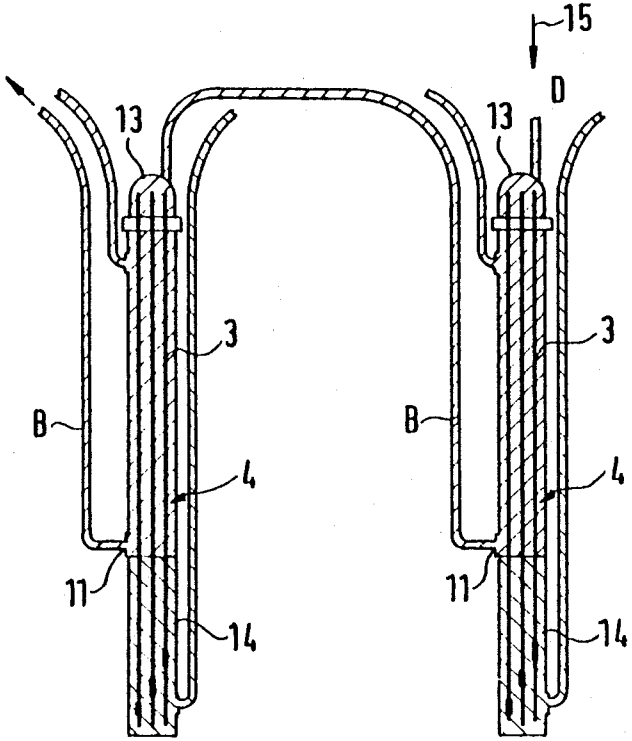

In FIG. 1, a vertical section is shown of a structural member or wall 1 of a prestressed concrete construction made up of a number of cells. It is assumed that the wall 1 is supported at the lower end on the ocean floor or on a foundation, and the upper end is located above the surface of the water. The height of the wall or structure can amount to 85 m or more.

Within the interior of the wall or structural member 1, there is a tensioning duct 3 formed by an axially elongated sheathing pipe 2 embedded within the structural member. A bundled tensioning member 4 is installed in the tensioning duct 3. As viewed in FIG. 1, the bundled tensioning member is made up of only three individual elements 5, actually it includes a greater number of individual elements, and the number is optional, however, nineteen elements 5, for example, steel wire strands, are displayed in the embodiment of FIGS. 2 to 4. In addition to the tensioning reinforcement, provided by the tensioning members 4, the structural member 1 also contains untensioned reinforcement 6 located within the wall between its outer surface and the tensioning duct 3. As indicated in FIG. 4, the individual elements 5 are welded to one another at the lower end 7 of the tensioning duct. Extending upwardly from the lower end of the duct 3 is an anchored length $L_v$ containing means 8 for the locally concentrated introduction of force. Means 8 are preferably metallic sleeves pressed onto the individual steel wire strands by an extrusion molding operation. Note FIG. 2. As a result, the individual elements 5 are combined into a bundle with the sleeves spaced apart at equal distances 1 from one another in groups for distributing the sleeves along the anchored length $L_v$ in as uniform a manner as possible. In this region, the bundle of individual elements are held together by a hoop 9, note FIG. 3.

Within the structural member 1, but outside the tensioning duct 3, tubular lines extend parallel to the duct, specifically a grouting line A, which has an opening 10, into the tensioning duct 3, at the lower end of the duct, that is, the lower end of the anchored length $L_v$. A flushing and grouting line B has an opening 11 into the tensioning duct 3, approximately at the junction between the anchored length $L_v$ and the tensioned length $L_s$ extending upwardly from the anchored length. Another line C extends into the upper end of the tensioning duct below an anchoring device 12. A fourth line D is connected to a cover cap 13 for the tensioning duct 3 for temporarily sealing the region of the anchoring device 12 during the construction operations. If the diameter of the sheathing tube can be increased, it is possible to locate the lines A and B inside the tensioning duct.

The method of installing and tensioning the tensioning member and bringing it into composite action with the structural member is explained in detail as follows with the aid of FIGS. *5a–5i* which represent in a schematic manner the different steps of carrying out the method of the present invention.

FIG. *5a* displays in a schematic manner the construction stage after the placement of the tensioning duct 3 with the grouting lines A, B and C in the structural member 1. As can be seen, line A has an opening 10 at the lower end of the anchored length $L_v$ communicating with the interior of the tensioning duct 3. Line B has an opening 11 at the transition from the anchored length $L_v$ to the tensioned length $L_s$ while the line C has an opening into the tensioning duct spaced closely below the upper end of the duct.

In the construction of a structural member which must be held in sea water so that it floats, as in the embodiment described here, precautions must be taken that the tensioning duct does not fill with sea water, since sea water has aggressive properties and can act corrosively on the sheathing pipe 2 forming the tensioning duct 3, as well as on the tensioning member 4 to be placed in the duct. Accordingly, the tensioning duct 3 is first filled with fresh water as is indicated in FIG. *5b*. The tensioning member 4 is then lowered into the tensioning duct 3 filled with fresh water as indicated in FIG. *5c*. As can be seen in this Figure, at its lower end the tensioning member 4 includes means 8 for additional anchorage as shown in FIG. 1. At its upper end, the tensioning member is held in an anchor disk 12 in a known manner. At this construction stage, the tensioning duct 3 is sealed at its upper end in the region of the anchoring device 12 by a cover cap 13, with line D connected to the cap.

In the construction stage shown in FIG. *5d*, a hardenable material 14 is injected or grouted into the tensioning duct through the line A. The hardenable material enters the duct through the opening 10 and fills the lower portion of the duct from the bottom in the upward direction. During this operation, lines C and D are closed so that the fresh water filling the tensioning duct 3 escapes through the line B. At the completion of the grouting step the anchored length $L_v$ of the duct 3 is completely filled with the hardenable material 14 and excess material exits through the opening 11 at the lower end of the line B. With the anchored length $L_v$ completely filled, the grouting operation is terminated and the line A is closed at its upper end.

In the next stage, as displayed in FIG. *5c*, fresh water is injected into the duct via the line D note arrow 15 so so that it rinses out any hardenable material 14 remaining in the line B, and the tensioning duct is rinsed free of the hardenable material to a point below the plane of the opening 11 from the line B. Accordingly, it is assured that the required anchored length $L_v$ is achieved and, at the same time, that the line B for grouting the tensioned length $L_s$, to be carried out subsequently, is still open. The rinsing process is continued until the material 14 sets to insure that the opening 11 from the line B in the tensioning duct 3 is not blocked due to settling of any residue. It may be advisable to interconnect a plurality of adjacent tensioning ducts 3 in the manner shown in FIG. *5f*. The outlet openings 10, 11 from the lines A, B into the tensioning duct 3, can have an oval shape, that is, in the shape of an elongated hole, for assuring that the passage remains open during any settling of the hardenable material.

After the hardenable material 14 sets, the tensioning member can be tensioned, note FIG. *5g*. An hydraulic press 16 is placed on the anchor disk 12 in a known manner for effecting the tensioning. Individual elements 5 forming the tensioning member 4 are anchored in the anchor disk in a known manner.

After the tensioning members 4 have been tensioned, another cover cap 13' is placed on the upper end of the tensioning duct and hardenable material 14 is injected into the line B and through the opening 11 so that it flows upwardly along the tensioned $L_2$ until it flows out of the lines C, D, one after the other, noted FIG. *5h*. To avoid the separation of water out of the hardenable material 14, the material could be injected subsequently through the line C after closing the line B at its upper end, note FIG. *5i*. The line D, opening from the highest point of the closing cap 13' insures that the entire tensioning duct 3 is completely filled with hardenable material 14 up to and including the region of the anchoring device 12.

While specific embodiments of the invention have been shown and described in detail to illustrate the application of the inventive principles, it will be understood that the invention may be embodied otherwise without departing from such principles.

We claim:

1. Bundled tensioning member having a long length for use in prestressing a concrete structure with subsequent composite action, said tensioning member formed of a plurality of individual tensioning elements such as at least one of steel rods, steel wired or steel wire strands, means forming an axially elongated tensioning duct located in the concrete structure, said tensioning duct extending generally upwardly and having a first end at the lower end thereof and a second end at the upper end thereof, said tensioning duct having an axial region extending from the first end thereof, said tensioning duct being accessible only at the second end, means for supporting said tensioning member adjacent the second end thereof, said means comprising an anchor disk, wherein the improvement comprises that said tensioning elements are joined together in a compact contacting unitary arrangement in the axial region at the first end of said tensioning duct, means secured on said tensioning members for affording additional anchoring with a hardenable material to be injected into the tensioning duct for providing a composite action and forming an anchored length in the axial region at the first end in said tensioning duct wherein the anchored length extends for the axial region of the duct from the first end thereof.

2. Bundled tensioning member, as set forth in claim 1, wherein said means for additional anchoring being formed ion said individual elements and offset relative to one another in the elongated direction of said tensioning duct.

3. Bundled tensioning member, as set forth in claims 1 or 2, wherein said individual elements are formed of steel wire strands, and said means for additional anchoring comprise metallic sleeves pressed on to said steel wire strands.

4. Bundled tensioning member, as set forth in claim 1, wherein said tensioning elements are joined together adjacent the first end of said tensioning duct by weldments.

5. Bundled tensioning member, as set forth in claim 1, wherein a plurality of grouting lines are connected to said tensioning duct, each of said grouting lines having an opening communicating with the interior of said tensioning duct and said openings being spaced apart in the elongated direction of said tensioning duct.

6. Method of installing an elongate bundled tensioning member formed of a plurality of individual tensioning elements in a generally upwardly extending structural member comprising the steps of placing the tensioning duct in the structural member in a generally upright position with the duct having an open upper end and a closed lower end, inserting a bundled tensioning member into the tensioning duct so that the tensioning member extends from adjacent the lower end to adjacent the upper end, connecting a first grouting line to the tensioning duct with the grouting line having an inlet and an outlet with the outlet connected to the tensioning duct adjacent the lower end thereof, connecting a second grouting line having an inlet and an outlet with the outlet connected to the tensioning duct intermediate the upper and lower ends thereof above the connection of said first grouting line, the opening from said second grouting line dividing the tensioning duct into a lower anchored length and an upper tensioned length, filling the tensioning duct with fresh water prior to introducing a hardenable material through the first grouting line and closing the upper end of the tensioning duct after placing the tensioning member in the duct, injecting the hardenable material into the first grouting line for anchoring the tensioned member for the anchored length of the tensioning duct, and displacing the fresh water by the hardenable material injected through the first grouting line, after setting of the hardenable material, tensioning the tensioning member in the tensioned length of said tensioning duct, injecting hardenable material through the second grouting line into the tensioning duct for enclosing the tensioning members within the tensioned length of the duct.

7. Method, as set forth in claim 6, wherein locating the first and second grouting lines outside the tensioning duct.

8. Method, as set forth in claim 6, wherein rinsing said tensioning duct with fresh water from the upper end thereof for removing hardenable material within the tensioned length of the tensioning duct and conveying the rinsing water out of the tensioning duct through the opening of the second grouting line.

9. Method, as set forth in claim 8, wherein continuing the rinsing process until the hardenable material sets in the anchored length.

10. Method, as set forth in claim 6, wherein connecting a third grouting line to said tensioning duct adjacent the upper end thereof, and injecting a hardenable material through the third grouting line into the upper end of the tensioning duct for filling the upper end of the tensioning duct.

11. Method, as set forth in claim 6, wherein joining one end of the tensioning element together into a compact contacting unitary arrangement before inserting the bundled tensioning member into the tensioning duct, and inserting the tensioning member for locating the one end of the tensioning elements at the closed lower end of the tensioning duct.

* * * * *